US007481259B2

(12) United States Patent
Hartman et al.

(10) Patent No.: US 7,481,259 B2
(45) Date of Patent: Jan. 27, 2009

(54) HALF MOON ARCH WINDOW INSERT

(76) Inventors: Renee Ann Hartman, 7416 Mesa Verde Trail, Ft. Worth, TX (US) 76137; Liz Ann Gould, 7416 Mesa Verde Trail, Fort Worth, TX (US) 76137

( * ) Notice: Subject to any disclaimer, the term of this patent is extended or adjusted under 35 U.S.C. 154(b) by 0 days.

(21) Appl. No.: 11/280,099

(22) Filed: Nov. 16, 2005

(65) Prior Publication Data

US 2006/0102294 A1 May 18, 2006

Related U.S. Application Data

(60) Provisional application No. 60/628,670, filed on Nov. 18, 2004.

(51) Int. Cl.
*E06B 9/06* (2006.01)

(52) U.S. Cl. ..... 160/84.07; 160/38; 160/134

(58) Field of Classification Search ..... 160/38, 160/134, 84.07, 19
See application file for complete search history.

(56) References Cited

U.S. PATENT DOCUMENTS 3,512,191 A * 5/1970 Wall ..... 5/692
5,152,331 A * 10/1992 Barone ..... 160/38
5,345,990 A * 9/1994 Potts ..... 160/38
5,505,245 A * 4/1996 Badalamenti ..... 160/38
5,918,435 A * 7/1999 McGowen ..... 52/311.1
6,047,421 A * 4/2000 Barone ..... 5/655.9
6,173,752 B1 * 1/2001 Nelson et al. ..... 160/38
6,877,545 B1 * 4/2005 Parkerson ..... 160/38
7,063,121 B2 * 6/2006 Zorbas et al. ..... 160/38
7,216,686 B2 * 5/2007 Repp et al. ..... 160/38

* cited by examiner

*Primary Examiner*—Katherine Mitchell
*Assistant Examiner*—Candace L. Bradford

(57) ABSTRACT

The purpose of this window treatment insert is to block out light and to enhance the decor. The insert can be covered with different types of fabric for a decorative appearance. The window insert is made to fit arch windows. The window insert is made of foam. The window insert is made with several slits in the foam to decorate at your own preference. The insert is simple, no hardware, and no sewing, gluing, no raw edges. If needed you can cut insert to fit or squeeze to fit. The window insert is two-sided. On one side the insert has at least four even spaced slits at top that meet together at the bottom making a point. On other side of insert there are at least four even spaced slits that meet a half circle slit at bottom. The fabric is pushed firmly into insert slits to make decorative appearance.

7 Claims, 3 Drawing Sheets

HALF MOON ARCH WINDOW INSERT

This application claims priority of provisional application Ser. No. 60/628,670 filed on Nov. 18, 2004.

STATEMENT REGARDING FEDERALLY SPONSORED RESEARCH OR DEVELOPMENT

"Not Applcable"

THE NAMES OF THE PARTIES TO A JOINT RESEARCH AGREEMENT

"Not Applicable"

INCORPORATION-BY-REFERENCE OF MATERIAL SUBMITTED ON A COMPACT DISC

"Not Applicable"

BACKGROUND OF THE INVENTION

Field of invention is the arch window treatment insert is related to an arch window.

Description of Related Art including information disclosed under CFR 1.97 and 1.98.

The arch window treatment insert has slits at top and bottom not for design but to hold fabric tight and firm to form a design that is on the front and back of the arch window treatment insert. The arch window treatment insert does not need hardware. The arch window treatment insert fits directly inside the arch window. The arch window treatment insert is measured for a custom fit. The arch window treatment insert is made for a arch window and is the shape of an arch window. The arch window treatment insert is not rectangular shape and is not a wall hanging. The arch window treatment insert blocks out light completely. The arch window blocks light out there for in conserves energy and has a decorative appearance.

BRIEF SUMMARY OF INVENTION

The purpose of the arch window treatment is to block out light and to enhance the decor. The arch window treatment insert can be covered with different types of fabric. The arch window treatment insert is a shape of an arch window. The arch window treatment insert is made for an arch window. The arch window treatment insert is made of foam. The arch window treatment insert is made with several slits in the foam to decorate the arch window treatment insert at your own preference. The arch window treatment insert is two-sided with different designs on each side. The arch window treatment insert has different patterns on each side. The arch window treatment insert has a slit at top of insert to hold fabric firm. The arch window treatment insert slit at bottom of insert to hold fabric firm. The slit made at top and bottom of the arch window treatment insert is to hold fabric firm not for decorative appearance. The slit at top and bottom of the arch window treatment insert hold fabric tight and firmly into place. The arch window treatment insert is simple, no hardware, no sewing, and no gluing, no raw edges. If needed you can cut the arch window treatment insert to fit or squeeze to fit. The arch window treatment window insert is custom measured to fit into an arch window.

BRIEF DESCRIPTION OF SEVERAL VIEWS OF THE DRAWINGS

The arch window treatment insert drawings FIG. 1-5 are on pages 4, 5, 6, 7, 8.

DETAILED DESCRIPTION OF THE INVENTION

Figure 1:
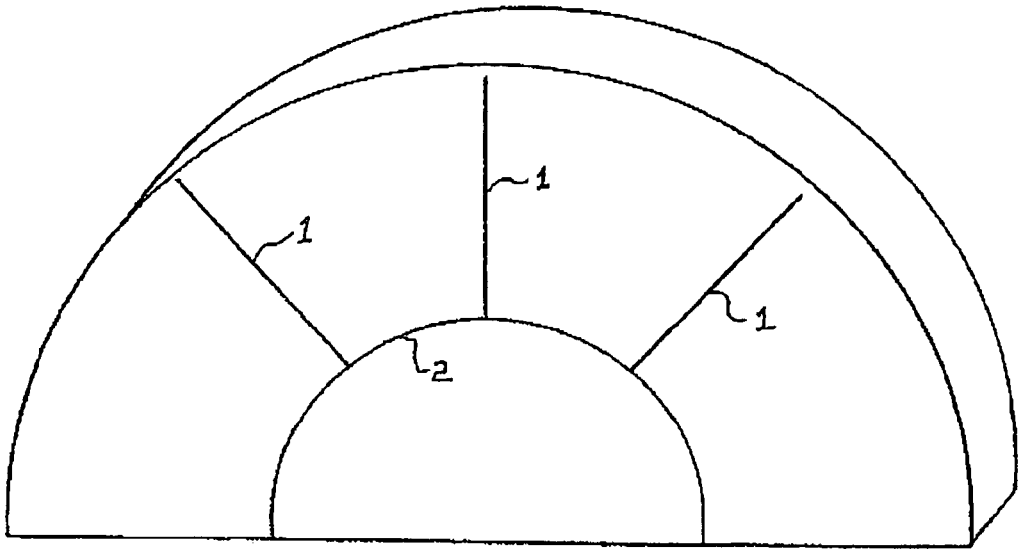
FIG. 1 the arch window treatment insert interior or exterior view drawing has three or more or less even spaced straight line groves that meet a flat curved grove.
Figure 2:
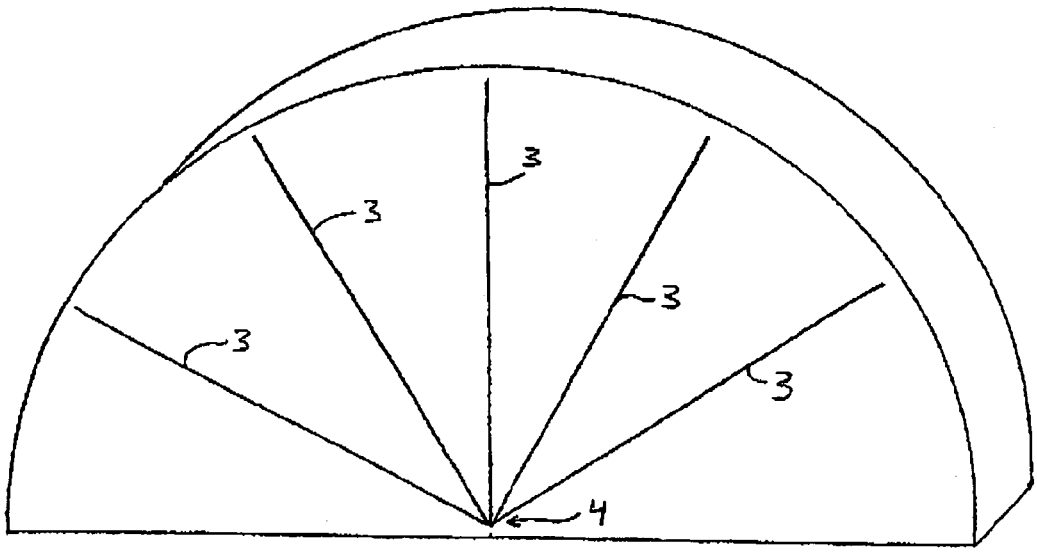
FIG. 2 the arch window treatment interior or exterior view of drawing has four or more even spaced straight line groves that meet at bottom point.
Figure 3:
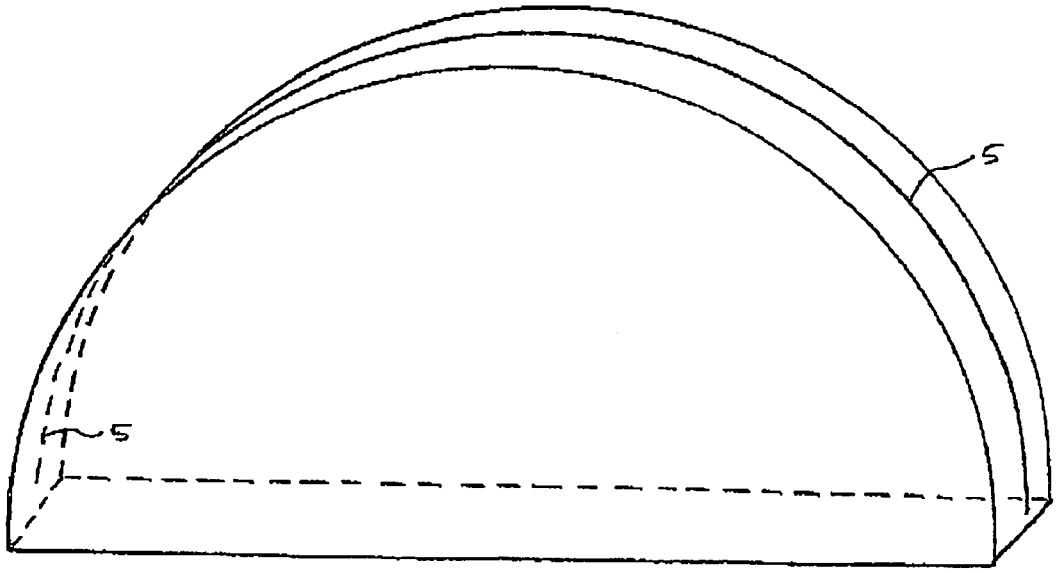
FIG. 3 top of the arch window treatment insert drawing has a straight line grove at top for material to hold material secure.
Figure 4:
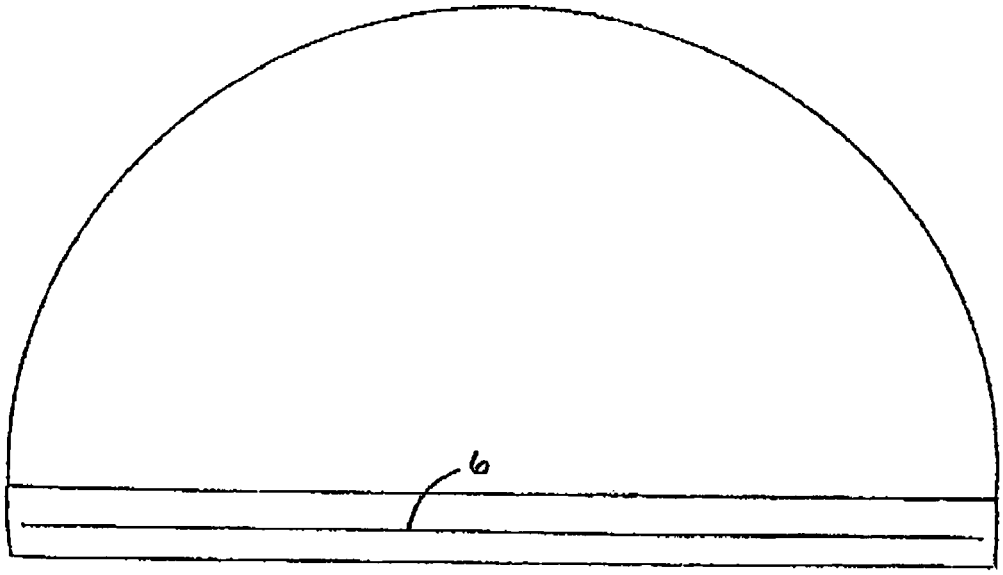
FIG. 4 the arch window treatment insert drawing has a straight line grove at bottom to hold material secure.
Figure 5:
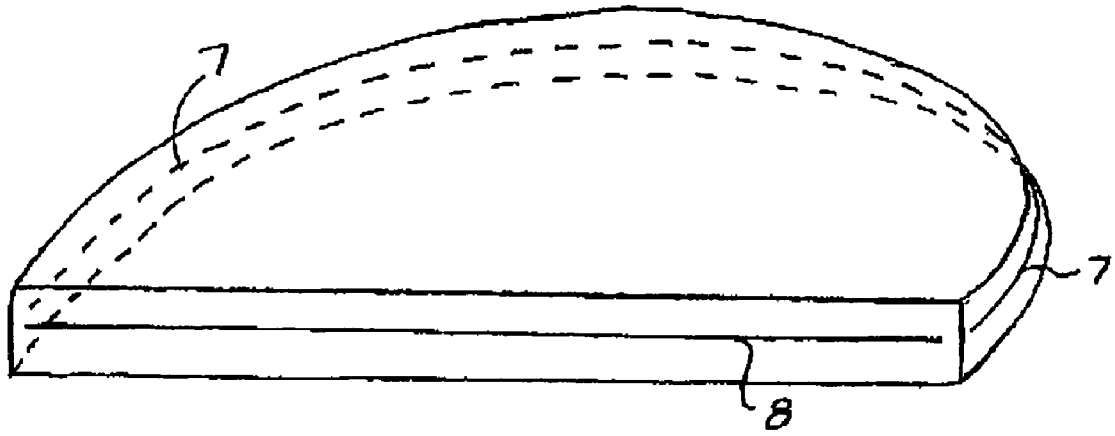
FIG. 5 the arch window treatment insert drawing has no straight line groves except for the top and bottom for the material to be held secure.

The arch window treatment insert is made for an arch window. The arch window treatment insert is the shape of an arch window. The arch window treatment insert fits into an arch window. The arch window treatment insert is self supporting does not need any hardware, curtain rod or a support beam. The arch window treatment insert is made of foam. The arch window treatment insert is as deep as an arch window. The depth, width, length and height of the arch window treatment insert depend on the arch window. The arch treatment window insert depends on the arch window for a custom fit. The straight line groves of the arch window treatment insert are made for material. The arch window treatment insert has straight line groves at top and at bottom to hold material secure. The arch window treatment insert has a view for the interior and exterior that are different depending on a arch window. The view or the arch window treatment insert can have three or more or less or none even straight line groves at top of the arch window treatment insert best seen in FIG. 1 arrow 1 meet at a curved line grove evenly spaced grove at center bottom of the arch window treatment insert best seen in FIG. 1 arrow 1 meet at FIG. 1 arrow 2. The material or materials can be held into the grove of the arch window treatment insert to make the design of choice. The arch window treatment insert view interior or exterior has four or more even spaced straight line groves at top of the arch window treatment insert as best seen in FIG. 2 arrow 3 that meet together at point at bottom of the arch window treatment insert making a point best seen FIG. 2 arrow 3 meet at bottom point at FIG. 2 arrow 4. The material can be held into groves of the arch window treatment insert. The top of the arch window treatment insert has a a straight line grove at top of the arch window treatment insert to hold material or materials firm best seen in FIG. 3 arrow 5. The arch window treatment insert has a straight line grove at bottom of the arch window treatment insert best seen in FIG. 4 arrow 6 to hold material secure. The arch window treatment insert has just straight line groves at top and bottom of the arch window treatment insert best seen in FIG. 5 arrow 7 at top grove FIG. 5 arrow 8 at bottom grove. The arch window treatment insert side has four or more or less even spaced straight line grove at the top of the arch window treatment insert that come together and form a point at bottom of the arch window treatment insert best seen in FIG. 2 arrow 3 meets at bottom to make a point best seen in FIG. 2 arrow 4. The arch window treatment insert on interior or exterior has three or more or less even spaced straight line grove best seen in FIG. 1 arrows 1 with straight line curved grove at center bottom of the arch window treatment insert meet arrow 2 at flat curved grove. The arch window treatment insert has three or more or less even spaced straight line groves at top of the arch window treatment insert that meet at top of the curved flat grove that is at the bottom of the arch window treatment insert best seen in FIG. 1 arrows 1 meet arrow 2. The material or materials are held secure into the straight line groves of the arch window treatment insert. The top of the arch window treatment insert has a straight line grove at top of the arch window treatment insert to hold material secure best seen in FIG. 3 arrow 5. The arch window treatment insert has a straight line grove at bottom of the arch window treatment insert to hold material secure best seen in FIG. 4 arrow 6.The arch treatment insert has straight line groves at top and bottom best seen in FIG. 5 top grove arrow 7 and bottom grove arrow 8. The arch window treatment insert drawings FIGS. 1-5 are on pages 4, 5, 6, 7 and 8.

The invention claimed is:

1. An insert for an arch-shaped window, comprising:

an arch-shaped member having an arch-shaped front surface, an opposing arch-shaped rear surface, a bottom surface, and a curved top surface;

a plurality of radially aligned slits in the front surface;

a plurality of radially aligned slits in the rear surface;

a slit extending along a portion of the length of the bottom surface; and a slit along a portion of the length of the top surface; wherein the plurality of radially aligned slits in the front surface are angularly offset from the plurality of radially aligned slits in the rear surface.

2. The insert according to claim 1, wherein the arch-shaped member is made of foam.

3. The insert according to claim 1, wherin the thickness of the arch-shaped member from the front surface to the rear surface is between about 0.5 inches and about eight inches.

4. The insert according to claim 1, wherin the radius of the arch-shaped member is larger than the radius of the arch-shaped window, such that the arch-shaped member is retained within the arch-shaped window by a press fit when installed into the arch-shaped window.

5. The insert according to claim 1, further comprising:

at least one arch-shaped slit in the front surface.

6. The insert according to claim 5, further comprising:

at least one arch-shaped slit in the rear surface.

7. The insert according to claim 1, further comprising:

a fabric material tucked into at least one of the slits.

* * * * *